US005582246A

United States Patent [19]

Dinh

[11] Patent Number: 5,582,246

[45] Date of Patent: Dec. 10, 1996

[54] FINNED TUBE HEAT EXCHANGER WITH SECONDARY STAR FINS AND METHOD FOR ITS PRODUCTION

[75] Inventor: Khanh Dinh, Gainsville, Fla.

[73] Assignee: Heat Pipe Technology, Inc., Alachua, Fla.

[21] Appl. No.: 390,544

[22] Filed: Feb. 17, 1995

[51] Int. Cl.[6] ..... F28F 1/20

[52] U.S. Cl. ..... 165/181; 165/151; 29/890.046; 29/890.043

[58] Field of Search ..... 165/182, 181, 165/151; 29/890.043, 890.046

[56] References Cited

U.S. PATENT DOCUMENTS

| | | | |
|---|---|---|---|
| 1,634,110 | 6/1927 | McIntyre | 165/182 |
| 1,992,646 | 2/1935 | Young | 165/182 |
| 2,089,340 | 8/1937 | Cobb | 257/262 |
| 2,537,984 | 1/1951 | Frisch | 165/182 |
| 2,656,808 | 10/1953 | Plumeri et al. | 165/181 |
| 2,737,370 | 3/1956 | Frisch et al. | 165/182 |
| 3,011,466 | 12/1961 | Simpelaar | 113/118 |
| 3,190,353 | 6/1965 | Storfer | 165/182 |
| 3,292,692 | 12/1966 | Person et al. | 165/182 |
| 3,384,168 | 5/1968 | Richter | 165/182 |
| 3,921,556 | 11/1975 | Wood et al. | 113/120 |
| 4,580,623 | 4/1986 | Smitte et al. | 165/182 X |
| 5,042,576 | 8/1991 | Broadbent | 165/151 |
| 5,117,905 | 6/1992 | Hesse | 165/182 |

FOREIGN PATENT DOCUMENTS

| | | | |
|---|---|---|---|
| 0214351 | 11/1957 | Australia | 29/890.043 |
| 322471 | 6/1902 | France | 165/182 |
| 380890 | 12/1907 | France | 165/182 |
| 0051150 | 4/1977 | Japan | 29/890.046 |
| 0321820 | 11/1929 | United Kingdom | 165/151 |

*Primary Examiner*—John Rivell
*Assistant Examiner*—Christopher Atkinson
*Attorney, Agent, or Firm*—Nilles & Nilles, S.C.

[57] ABSTRACT

The heat exchange efficiency of a finned tube heat exchanger is increased by providing secondary heat exchange surfaces which are dimensioned and configured to maximize heat exchange with the surrounding fluid. These secondary heat exchange surfaces, formed from materials which would normally be wasted when blanks are removed from the fins to form apertures for receiving the tubes, are formed by bending the preserved materials into star-shaped structures which increase the surface area in contact with the surrounding fluid. The secondary heat exchange surfaces increase the surface area of the fin which is available for heat exchange, and provide this increased surface area at a location maximizing heat transfer capability to the surrounding fluid and to the tubes. The heat exchanger can be constructed in a simple and inexpensive process while preventing fin presses or related machinery from being jammed by removed materials.

20 Claims, 3 Drawing Sheets

FINNED TUBE HEAT EXCHANGER WITH SECONDARY STAR FINS AND METHOD FOR ITS PRODUCTION

BACKGROUND OF THE INVENTION

1. Field of the Invention

The invention relates to heat exchangers and, more particularly, relates to an improved finned tube-type heat exchanger and to a method of making the same.

2. Discussion of the Related Art

Finned tube heat exchangers are well known for exchanging heat between fluid flowing through tubes and an ambient fluid surrounding the tubes. The typical finned tube heat exchanger includes (1) a plurality of parallel fins formed from thin sheets of aluminum or another thermally conductive material and (2) a plurality of parallel tubes extending through apertures in the fins and formed from copper or another thermally conductive metal. The tubes are expanded against collars surrounding the apertures to provide a firm mechanical connection between the fins and tubes and to enhance heat exchange by conduction between the tubes and fins.

Referring now to FIGS. 1–3, a finned tube heat exchanger 10 is typically constructed by first punching blanks 12 out of an aluminum sheet 14 to form apertures 16 (FIG. 1), expanding the apertures 16 to form collars 18 (FIG. 2), and then inserting tubes 20 through the apertures 16 and expanding the tubes 20 into the collars 18 (FIG. 3).

Forming apertures in the sheets 14 by removing blanks 12 exhibits several drawbacks and disadvantages both during manufacturing and in use. During manufacturing, the blanks 12 tend to litter the work area and frequently jam the fin press and related machinery. In use, performance of the heat exchanger 10 is significantly degraded because the surface area of the blanks 12, which would otherwise be available for heat exchange, is lost when the blanks 12 are punched out of the sheets 14. The heat exchange capacity of a particular fin construction varies with available surface area. Hence, completely removing the blanks significantly decreases the overall heat exchange efficiency of a heat exchanger. In a typical finned tube heat exchanger using ⅜" tubes about 14% of the available fin surface is lost when the blanks are removed, with a proportionate decrease in heat exchange capacity. This lost available surface area increases to 17% for heat exchangers using ½" tubes, with a further decrease in heat exchange capacity.

Proposals have been made to increase the heat exchange efficiency of finned tube heat exchangers. For instance, U.S. Pat. No. 5,042,576 to Broadbent (the Broadbent patent) recognizes that heat exchange capacity is higher at relatively high temperature differentials and decreases with decreasing temperature differentials. The Broadbent patent attempts to increase the heat exchange capacity of a finned tube heat exchanger of designated overall dimensions by increasing the surface area of the fin assembly which contacts streams of ambient fluid which are at or near ambient temperature. This surface area is increased by deforming the major surface area of the fins into raised louvers or lances which extend at different levels with respect to each other and with respect to the major surfaces of the fins and which accordingly contact different airstreams flowing through the heat exchanger.

The Broadbent patent also recognizes that the overall efficiency of a heat exchanger depends not only on the rate of heat exchange, but also on the cost of forcing air through the heat exchanger. The Broadbent patent attempts to minimize this cost by maintaining a low pressure drop across the heat exchanger through the use of louvers which are relatively flat and which extend in parallel with the direction of airflow.

The raised lance or louvered finned tube heat exchanger proposed by Broadbent, though more efficient than heat exchangers employing only planar fins, is relatively expensive to fabricate and to install because the louvers must be formed in the fins. Moreover, because the apertures for receiving the tubes are formed by punching blanks out of the fins, the surface area of these apertures is lost for heat exchange purposes, with a resultant and proportional decrease in heat exchange capacity. The increased heat exchange capacity resulting from the raised lances or louvers is thus at least partially offset by the lost fin surface area at the apertures.

U.S. Pat. Nos. 1,634,110 to McIntyre, 2,089,340 to Cobb, 3,190,353 to Storfer, 3,384,168 to Richter, and 5,117,905 to Hesse all disclose heat exchangers in which some of the materials from the apertures of heat exchange fins is preserved. However, the materials preserved in the heat exchanger of each of these patents is used to facilitate the mounting of the fins on the tubes (see McIntyre, Cobb and Storfer), and/or to set the spacing between adjacent fins (see Richter and Hesse). Even those patents which recognize an increase in heat exchange capacity from such structures merely attempt to increase heat exchange capacity by increasing the surface contact area between the tubes and the fins, and not by forming secondary heat exchange surfaces operating at least generally in parallel to the main fin surfaces.

OBJECTS AND SUMMARY OF THE INVENTION

It is therefore an object of the invention to provide an improved finned tube heat exchanger which is simple to fabricate and which exhibits increased heat exchange capacity with no waste of material.

Another object of the invention is to provide a method of making a finned tube heat exchanger without having to remove blanks which may jam the fin press and related machinery.

In accordance with a first aspect of the invention, these objects are achieved by providing a finned tube heat exchanger which includes (a) at least one tube adapted to receive a heat-exchange fluid, and (b) a plurality of fins. Each of the fins is formed from a thermally conductive metal sheet and has a major surface forming a primary heat exchange surface. Each of the metal sheets (a) has an aperture formed therein which receives the tube (b) has a collar formed therein which surrounds the aperture, which is in thermal contact with the tube, and which extends at least generally perpendicularly from the major surface, and (c) includes a plurality of generally planar secondary heat exchange surfaces which have a combined surface area essentially equal to a surface area of the aperture. Each of the secondary heat exchange surfaces is made from material removed from the aperture and is spaced from the major surface.

In order to maximize contact between the fins and fluid streams which are at or near ambient temperature, the secondary heat exchange surfaces of a first fin are spaced from a second fin located adjacent the first fin. This effect could be achieved by providing a design in which the major surface is recessed in the vicinity of the collar, and each of the secondary heating surfaces is bent to a position in which it extends generally in parallel with the major surface through substantially its entire length. Alternatively, the recess in the major surface could be omitted, and each of the secondary heat exchange surfaces could be bent downwardly from its inner to outer end.

In order to maximize heat exchange capacity while minimizing the pressure drop across the fins, each of the secondary heat exchange surfaces is generally triangular in shape such that all of the secondary heat exchange surfaces in combination form a star-shaped structure which contacts the tube.

Yet another object of the invention is to provide a method of making a finned tube heat exchanger exhibiting improved heat exchange efficiency.

In accordance with another aspect of the invention, this object is achieved by first providing a metal sheet having a generally planar surface, and then punching an indent in the metal sheet, the indent having a generally planar surface spaced from the surface of the sheet by a collar. Other steps include slitting the planar surface of the indent to form a plurality of triangular members, pushing inner ends of the triangular members away from the sheet, thereby forming an aperture in the sheet surrounded by the triangular members and bordered by the collar, and then bending the triangular members downwardly and outwardly away from the sheet to a position in which each of the triangular members is spaced from the major surface. Assembly is preferably completed by expanding a tube against the collar to form a finned tube heat exchanger in which a major surface of the sheet and parallel surface of the triangular members form primary and secondary heat exchange surfaces of a fin of the heat exchanger.

These and other objects, features and advantages of the invention will become apparent to those skilled in the art from the following detailed description and the accompanying drawings. It should be understood, however, that the detailed description and specific examples, while indicating preferred embodiments of the present invention, are given by way of illustration and not of limitation. Many changes and modifications may be made within the scope of the present invention without departing from the spirit thereof, and the invention includes all such modifications.

BRIEF DESCRIPTION OF THE DRAWINGS

Preferred exemplary embodiments of the invention are illustrated in the accompanying drawings in which like-reference numerals represent like parts throughout and in which.

DETAILED DESCRIPTION OF THE PREFERRED EMBODIMENTS

1. Résumé

Pursuant to the invention, the heat exchange efficiency of a finned tube heat exchanger is increased by providing secondary heat exchange surfaces which are dimensioned and configured to maximize heat exchange with the surrounding fluid. These secondary heat exchange surfaces, formed from materials which would normally be wasted when blanks are removed from the fins to form apertures for receiving the tubes, are formed by bending the preserved materials into star-shaped structures which increase the surface area in contact with the surrounding fluid. The secondary heat exchange surfaces increase the surface area of the fin which is available for heat exchange, and provide this increased surface area at a location maximizing heat transfer capability to the surrounding fluid and to the tubes. The heat exchanger can be constructed in a simple and inexpensive process while preventing fin presses or related machinery from being jammed by removed materials.

2. Construction of Heat Exchanger

Figure 8:
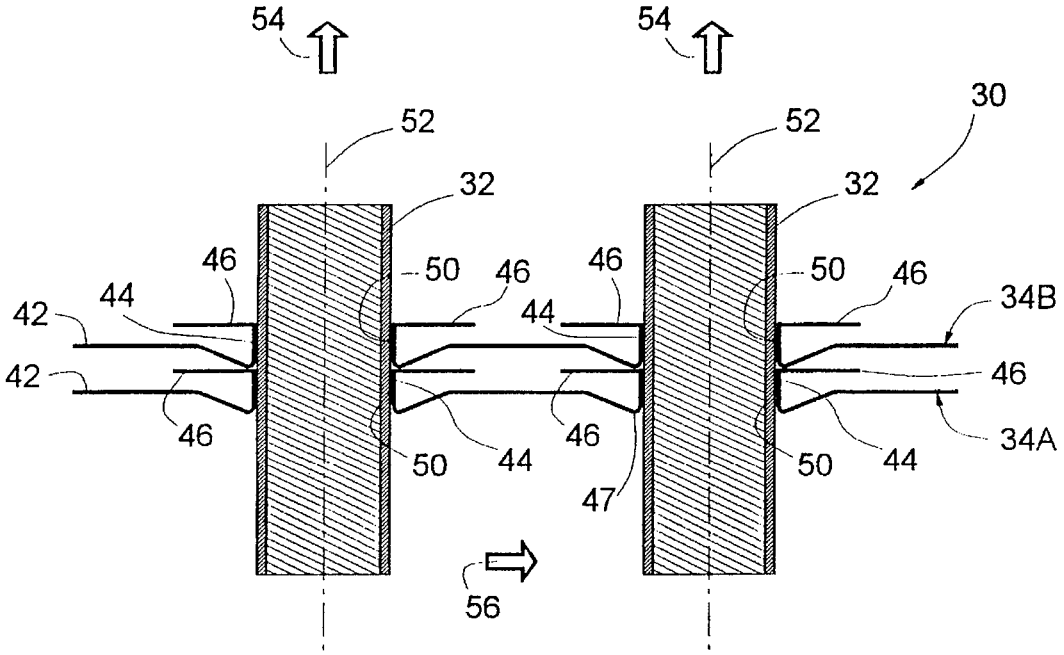

Referring to FIG. 8, a finned tube heat exchanger 30 constructed in accordance with the present invention is produced by expanding or otherwise mechanically and thermally bonding tubes 32 to stacked fins 34*a* and 34*b*. The tubes 32 typically, but not necessarily, form a single serpentine tube coil and receive a fluid to be heated or cooled. The fins 34*a* and 34*b* exchange heat with the tubes 32 and with an ambient fluid, typically air.

Figure 1:
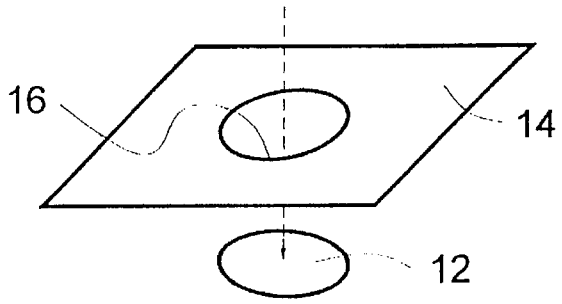
Fig. 1 (PRIOR ART)
FIGS. 1–3 schematically illustrate the sequence of producing a prior art finned tube heat exchanger and are appropriately labelled "PRIOR ART"
Figure 2:
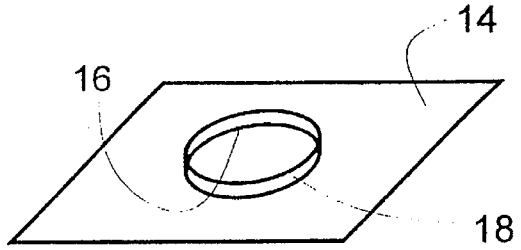
Fig. 2 (PRIOR ART)
Figure 3:
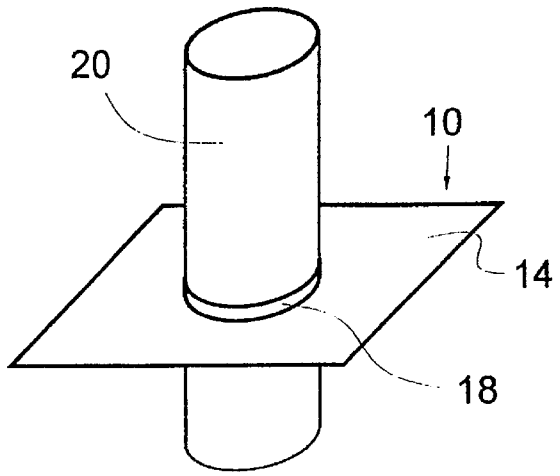
Fig. 3 (PRIOR ART)
Figure 4:
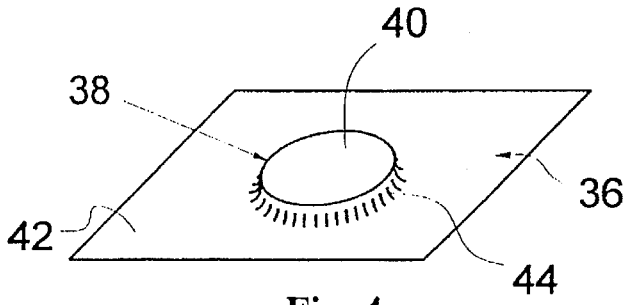
FIGS. 4–8 illustrate the manner in which a finned tube heat exchanger can be constructed in accordance with the present invention, with a cross-section of a portion of the resulting heat exchanger being illustrated in FIG. 8.
Figure 5:
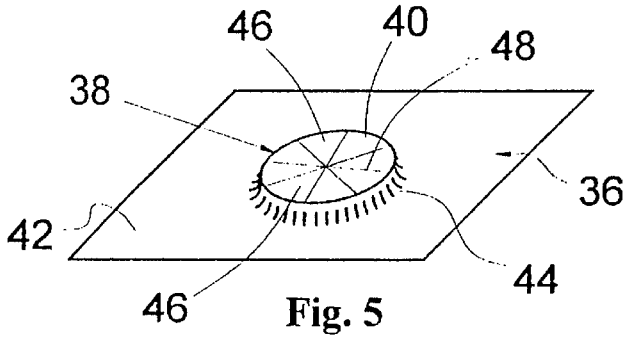

Referring to FIG. 4, the production of each fin starts by providing a metal sheet 36 which typically is formed from aluminum, but which may be formed from any suitable thermally conductive metal material. A plurality of indents 38 are then punched in each sheet 36 using any suitable punching tool, with each indent 38 having a generally planar surface 40 spaced from the major surface 42 of the sheet 36 by a collar 44. Next, the planar surface 40 of each indent 38 is slit in a star pattern as illustrated in FIG. 5 to form a plurality of triangular members 46 each emanating from a center point 48 and terminating at the outer axial end of the collar 44. The slits may extend either partially or completely through the sheet 36 and may be cut by any suitable cutting tool or even by a scribing surface formed on the head of the punch forming the indent 38.

Figure 6:
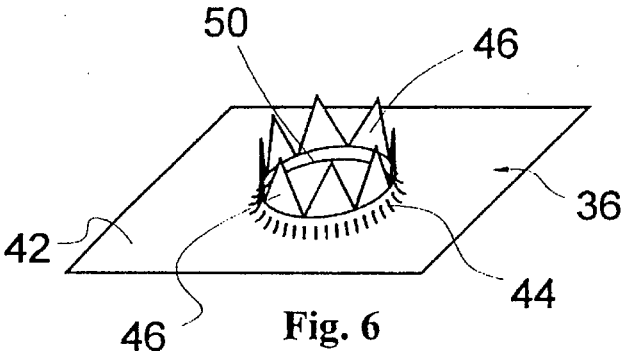

The inner ends of the triangular members 46 are pushed away from the sheet 36 as illustrated in FIG. 6 to form a collar 44. The pushing step may be performed simultaneously with the slitting step using a pointed punch having a scribing surface which simultaneously (1) slits the sheet 36 to form the members 46 and (2) forces the members 46 upwardly to form the collar 44.

Figure 7:
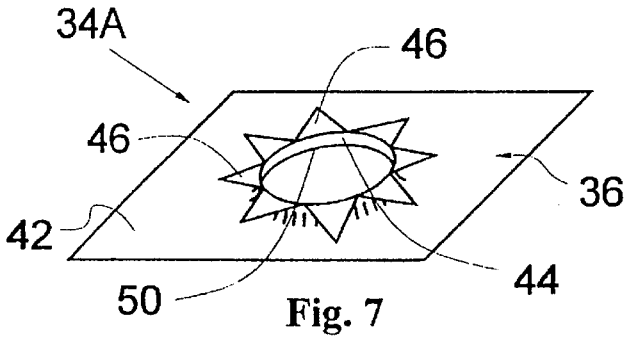

The triangular members 46 are then bent downwardly and outwardly away from the collar 44, using a suitable plunger, to the position illustrated in FIG. 7 in which each of the triangular members 46 extends generally in parallel with the major surface 42 of the sheet 36 and generally perpendicularly to the collar 44. The plunger is preferably used in conjunction with a die having a shoulder which slopes downwardly from its outer radial edge by an amount which in use will cause the sheet 36 to be depressed by about one-half the spacing between adjacent fins 34*a*, 34*b* (FIGS. 7 and 8). The radial length of the resulting circular depression 47 should be no greater than the length of the triangular members 46 for reasons detailed below. A retainer plate may if desired be added to retain the distal ends of the members 46. The fin 34*a* or 34*b* is complete at this time.

Next, copper or other thermally conductive tubes 32 are expanded against or otherwise mechanically bonded to the collars 44 of axially-aligned apertures 50 in the adjacent fins 34*a* and 34*b* as illustrated in FIG. 8. The central axes of the tubes 32 preferably extend perpendicularly to the major surfaces 42 of the fins 34*a* and 34*b* during the expanding operation to maximize the strength of the resulting connection. The fins 34*a* and 34*b* are stacked generally on top of one another with the spacing between adjacent fins being determined by the height of the collars 44 and the depth of the depressions 47. By forming depressions 47 which are about ½ of the height of the collars in the manner described above, the members 46 will be positioned approximately half way between the two adjacent major surfaces 42. The ends of the tubes 32 are then connected to one another and filled with refrigerant or another fluid to form the heat exchanger 30. Heat exchanger 30 is then placed in a location in which the fluid flowing through the tubes 32 in the direction of arrows 54 in FIG. 8 exchanges heat with an ambient fluid, typically air, flowing through the heat exchanger in the direction of arrow 56 in FIG. 8 with the help of the fins 34*a* and 34*b*.

Referring especially to FIGS. 7 and 8, primary and secondary heat exchange surfaces of the completed heat exchanger 30 are formed by the major surfaces 42 of each fin and by the triangular members 46 surrounding each aperture 50, respectively. These primary and secondary heat exchange surfaces act in conjunction with one another to increase the heat exchange efficiency of the heat exchanger 30. The increase in heat exchange efficiency is rather dramatic for several reasons.

First, the total surface area of each fin 34*a* or 34*b* available for heat exchange is increased by an amount proportional to the combined areas of the apertures 50. This increased surface area may, depending upon the diameter of the tubes 32 and the areas of the spaces between the tubes, range from 10% to 20%. In practice, the available surface area will typically increase by about 14% in heat exchangers employing ⅜" tubes and by about 17% heat exchangers employing ½" tubes. Heat exchange capacity is in generally proportional to available heat exchange area. Hence, the heat exchange capacity of the heat exchanger 30 can be expected to increase proportionally to the increase in surface area.

Second, as discussed above, at least a major portion of the secondary heat exchange surfaces formed by the triangular members 46 of each fin 34*a* or 34*b* are spaced apart from both the primary heat exchange surface formed by the major surface 42 of the same fin and the heat exchange surfaces of the adjacent fin (the spacing being aided by the fact that radial length of the depression 47 is shorter than that of the triangular members 46 as described above and as illustrated in FIG. 8 such that the triangular members extend beyond the depression 47). This spacing significantly enhances contact with a stream of air or another fluid at or near ambient temperature, thus further enhancing heat exchange efficiency.

Third, the secondary heat exchange surfaces formed by the triangular members 46 increase turbulence of fluid flowing past the fins 34*a* or 34*b*, further enhancing contact with fluid at or near ambient temperature and still further increasing heat exchange efficiency. However, because the triangular members 46 extend at least generally in parallel with the major surfaces 42 of the fins 34*a* and 34*b*, overall resistance to fluid flow is not significantly increased. The resulting heat exchanger thus exhibits a lower overall pressure drop compared to some other fin designs providing the same amount of heat exchange.

Fourth, unlike the system disclosed in the Broadbent patent in which secondary heat exchange surfaces are located remote from the tubes, the triangular members 46 are in direct contact with the tubes 32 and are capable of direct conductive heat exchange with the tubes 32.

Heat exchanger 30 is also much easier to construct than louvered or raised lance heat exchangers such as that disclosed in the Broadbent patent because additional metal-working at locations remote from the apertures 50 is not required. Of course, the heat exchange efficiency of the heat exchanger 30 may if desired be increased still further by adding raised lances or louvers such as those disclosed in the Broadbent patent.

Figure 9:
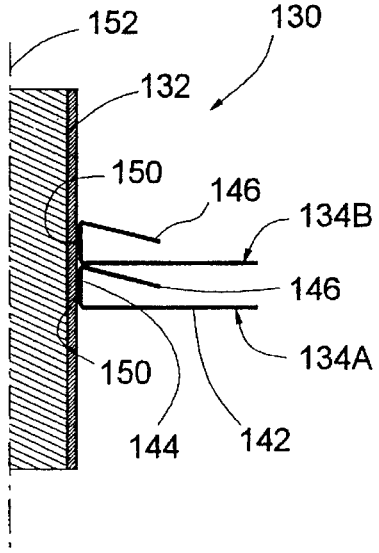
FIG. 9 illustrates a portion of a finned tube heat exchanger constructed in accordance with a second embodiment of the present invention.

Many changes and modifications could be made to the present invention without departing from the spirit thereof. For instance, the members 46 need not be triangular in shape. In addition, referring to FIG. 9, a portion of a heat exchanger 130 is illustrated which differs from the heat exchanger 30 of FIGS. 7 and 8 primarily in that the primary heat exchange surfaces 142 are not depressed in vicinities of the collars 144. The spacing between adjacent fins is therefore determined solely by the height of the collars 144. The spacing between primary and secondary heat exchange surfaces in this instance is maintained by bending downwardly the triangular members forming the secondary heat exchange surfaces 146. Heat exchanger 130 is otherwise identical in construction to the heat exchanger 30 described above. Components corresponding to the components of heat exchanger 30 are, accordingly, denoted by the same reference numerals, incremented by 100.

The scope of further changes and modifications which could be made to the present invention without departing from the spirit thereof will become apparent from the appended claims.

I claim:

1. A finned tube heat exchanger comprising:

(A) at least one tube adapted to receive a heat-exchange fluid; and (B) a plurality of fins each of which has a major surface forming a primary heat exchange surface, each of said fins being formed from a thermally conductive metal sheet, wherein each of said metal sheets (1) has an aperture formed therein which receives said tube;

(2) has a collar formed therein which borders said aperture, which is in thermal contact with said tube, and which extends at least generally perpendicularly from the major surface thereof; and (3) includes a plurality of generally planar secondary heat exchange surfaces which have a combined surface area essentially equal to a surface area of said aperture, each of said secondary heat exchange surfaces (a) being made from material removed from said aperture, and (b) being spaced from said major surface, wherein at least major portions of the secondary heat exchange surfaces of a first fin are spaced apart from a second fin located adjacent said first fin.

2. A finned tube heat exchanger as defined in claim 1, wherein a circular depression is formed in said major surface of one of said fins, surrounds the collar of the one fin, and extends axially away from the one fin.

3. A finned tube heat exchanger as defined in claim 2, wherein each of said secondary heat exchange surfaces extends generally in parallel with said major surface through substantially an entire radial length of the secondary heat exchange surface.

4. A finned tube heat exchanger as defined in claim 2, wherein said collar has an axial height d, and wherein said depression has a depth of about ½ d.

5. A finned tube heat exchanger as defined in claim 1, wherein each of said secondary heat exchange surfaces extends generally in parallel with said major surface through substantially an entire radial length of the secondary heat exchange surface.

6. A finned tube heat exchanger as defined in claim 1, wherein said primary heat exchange surface is generally planar in the vicinity of said collar, and wherein each of said secondary heat exchange surfaces is bent downwardly from inner to outer ends thereof.

7. A finned tube heat exchanger as defined in claim 1, wherein each of said secondary heat exchange surfaces is generally triangular in shape such that all of said secondary heat exchange surfaces in combination form a star-shaped structure which contacts said tube.

8. A finned tube heat exchanger comprising:

(A) a plurality of parallel tubes adapted to receive a heat-exchange fluid; and (B) a plurality of spaced fins each of which is formed from a metal sheet presenting a major surface which extends at least generally perpendicularly to said tubes and which presents a primary heat exchange surface, wherein (1) a plurality of apertures are formed through each of said sheets, each of said apertures receiving a respective one of said tubes, (2) a plurality of collars are formed in each of said sheets, each of which surrounds a respective one of said apertures and extends generally perpendicularly from the major surface of a respective sheet in contact with a respective one of said tubes, and (3) generally planar secondary heat exchange surfaces are formed from each of said sheets and are spaced from two adjacent primary heat exchange surfaces, each of said secondary heat exchange surfaces (a) being made from material punched from one of the apertures in the respective sheet, and (b) being connected to the respective sheet by one of said collars, wherein a designated number of said secondary heat exchanger surfaces surround each of said collars, each of said secondary heat exchange surfaces is generally triangular in shape such that all of the secondary heat exchange surfaces surrounding each of said collars in combination form a star-shaped structure which extends at least generally in parallel with the major surface of the respective sheet, the secondary heat exchange surfaces surrounding each of said apertures, in combination, have a surface area essentially equal to a surface area of the respective aperture, and wherein each of said tubes is expanded against the collars surrounding the respective apertures.

9. A finned tube heat exchanger as defined in claim 8, wherein downwardly facing circular depressions are formed in said major surfaces and surround said collars, said depressions having a depth which is about ½ of the distance between the major surfaces of two adjacent fins, and wherein each said secondary heat exchange surfaces is located approximately half way between the major surfaces of said two adjacent fins and is positioned beneath an adjacent one of said circular depressions such that at least a major portion thereof is spaced from both the major surface of a sheet from which said secondary heat exchange member is formed and from a lower surface of the adjacent circular depression.

10. A finned tube heat exchanger as defined in claim 8, wherein said major surfaces are generally planar in the vicinity of said collars, and wherein the spacing between adjacent fins is determined by the height of said collars.

11. A finned tube heat exchanger as defined in claim 10, wherein each of said secondary heat exchange surfaces is bent downwardly from inner to outer ends thereof.

12. A finned tube heat exchanger as defined in claim 8, wherein the combined surface area of the secondary heat exchange surfaces of each of said fins is about 10% to 20% of the surface area of the associated primary heat exchange surface.

13. A method comprising:

(A) providing a first metal sheet having a first generally planar major surface;

(B) punching an indent in said first metal sheet, said indent having a generally planar surface spaced from said first major surface by a collar;

(C) slitting said planar surface of said indent to form a plurality of generally planar triangular members;

(D) pushing said generally planar triangular members away from said first metal sheet, thereby forming a first aperture in said first metal sheet surrounded by said generally planar triangular members and bordered by said collar, wherein said generally planar triangular members have a combined surface area essentially equal to a surface area of said first aperture; then (E) bending said generally planar triangular members downwardly and outwardly away from said collar to a position in which each of said generally planar triangular members extends outwardly from said collar and in which at least a major portion of each of said generally planar triangular members is spaced from said first major surface of, thereby forming a plurality of generally planar secondary heat exchange surfaces which are spaced from said first major surface;

(F) providing a second metal sheet having a second generally planar major surface, a second aperture being formed in said second sheet; and (G) mounting said second rectal sheet above said first metal sheet such that said second aperture is located directly above said first aperture and such that at least a substantial portion of each of said secondary heat exchanger surfaces is spaced from said second metal sheet.

14. A method as defined in claim 13, further comprising (A) forming a depression in said first major surface around said collar, said depression having a designated depth and maintaining a designated distance between said generally planar triangular members and said first major surface; and (B) providing said second metal sheet with 1) a second collar which borders said second aperture and which extends upwardly from said second major surface and 2) a depression which extends downwardly from said second major surface and which has a radius which is smaller than a radial length of said secondary heat exchange surfaces.

15. A method as defined in claim 13, wherein said first major surface is generally planar in the vicinity of said collar, and wherein said bending step comprises bending each of said triangular members to a position in which it extends downwardly from inner to outer ends thereof.

16. A method as defined in claim 13, further comprising expanding a tube against said collar to form a finned tube heat exchanger in which said first major surface and parallel surfaces of said triangular members form primary and secondary heat exchange surfaces of a fin of said heat exchanger.

17. A method as defined in claim 16, wherein said collar is a first collar, and wherein said second metal sheet forms a second fin and has a second collar which borders said second aperture and which extends upwardly from said second major surface, and further comprising expanding said tube against said second collar.

18. A method as defined in claim 17, wherein the height of said first collar determines the spacing between said fins.

19. A method comprising:

(A) providing a heat exchanger including (1) at least one tube; and (2) a plurality of fins each of which has a major surface forming a primary heat exchange surface, each of said fins being formed from a thermally conductive metal sheet, wherein each of said metal sheets (a) has an aperture formed therein which receives said tube;

(b) has a collar formed therein which borders said aperture, which is in thermal contact with said tube, and which extends at least generally perpendicularly from the major surface thereof; and (c) includes a plurality of generally planar secondary heat exchange surfaces which have a combined surface area essentially equal to a surface area of said aperture, each of said secondary heat exchange surfaces (a) being made from material removed from said aperture, and (b) being spaced from said major surface, wherein at least major portions of the secondary heat exchange surfaces of a first fin are spaced apart from a second fin located adjacent said first fin;

(B) drawing an ambient fluid through said heat exchanger in contact with said fins such that said secondary heat exchange surfaces increase turbulence of ambient fluid flow through said heat exchanger without significantly increasing resistance to overall ambient fluid flow through said heat exchanger;

(C) conveying a heat exchange fluid through said tube;

(D) exchanging heat, via convective heat transfer, between said heat exchange fluid and said tube and between said ambient fluid and said primary and secondary heat exchange surfaces; and (E) exchanging heat, via conductive heat transfer, between said tube and said primary and secondary heat exchange surfaces.

20. A finned tube heat exchanger as defined in claim 3, wherein said circular depression has a radius which is shorter than the radial length of said secondary heat exchange surfaces.

* * * * *

UNITED STATES PATENT AND TRADEMARK OFFICE

CERTIFICATE OF CORRECTION

PATENT NO. : 5,582,246
DATED : December 10, 1996
INVENTOR(S) : Dinh et al.

It is certified that error appears in the above-identified patent and that said Letters Patent is hereby corrected as shown below:

Column 5, Line 26, after "17%" insert --in--.
Column 5, Line 27, delete "in".
Column 6, Line 47, after "the" insert --collar of the--.
Column 7, Line 43, after "each" insert --of--.
Column 8, Line 22, delete "rectal" and insert --metal--.

Signed and Sealed this

Twenty-fifth Day of February, 1997

Bruce Lehman

*Attest:*

BRUCE LEHMAN

*Attesting Officer*

*Commissioner of Patents and Trademarks*